US006629536B1

(12) United States Patent
Lane

(10) Patent No.: US 6,629,536 B1
(45) Date of Patent: Oct. 7, 2003

(54) HAIR ACCESSORY

(75) Inventor: Teresa Lane, Kansas City, MO (US)

(73) Assignee: Celebrity Signatures International, Inc., Kansas City, MO (US)

( * ) Notice: Subject to any disclaimer, the term of this patent is extended or adjusted under 35 U.S.C. 154(b) by 0 days.

(21) Appl. No.: 09/782,481

(22) Filed: Feb. 13, 2001

(51) Int. Cl.[7] ..... A41G 5/00
(52) U.S. Cl. ..... 132/53; 132/201
(58) Field of Search ..... 132/53, 54, 55, 132/56, 201, 105, 275; D28/92, 93

(56) References Cited

U.S. PATENT DOCUMENTS 1,713,616 A * 5/1929 Oppenheim ..... 132/53
3,280,826 A * 10/1966 Jenkins ..... 132/53
3,434,481 A * 3/1969 Mazzocco ..... 132/53
3,485,249 A * 12/1969 Mast ..... 132/55
3,520,310 A * 7/1970 Witmondt ..... 132/53
3,910,291 A * 10/1975 Kim ..... 132/53
D356,398 S * 3/1995 Hafid ..... D28/92
5,873,373 A * 2/1999 Narvick ..... 132/54
6,016,814 A * 1/2000 Elliott ..... 132/201
6,019,107 A * 2/2000 Overmyer et al. ..... 132/53
6,105,584 A * 8/2000 Williams ..... 132/53
6,257,250 B1 * 7/2001 Sartena ..... 132/275

* cited by examiner

*Primary Examiner*—John J. Wilson
*Assistant Examiner*—Robyn Keiu Doan
(74) *Attorney, Agent, or Firm*—Armstrong Teasdale LLP

(57) ABSTRACT

A method for fabricating a hair accessory to supplement a user's natural hair is provided. The method includes providing a plurality of hair strands and a hair clip. The method further includes attaching the hair strands to the clip such that the clip is substantially concealed by the strands when the clip is attached to the user's natural hair.

19 Claims, 5 Drawing Sheets

HAIR ACCESSORY

BACKGROUND OF THE INVENTION

This invention relates generally to hair accessories and, more particularly, to hair accessories that supplement the natural hair of a user.

Users supplement their natural hair to allow a wider variety of hair styles to be imparted to the user's hair. Additionally, when users are endowed with relatively little hair, the users can supplement their hair to create the impression of a fuller head of hair. At least one known form of a hair piece provided for these purposes by attaching a hair switch to a hair clip such that the hair piece hangs from the hair clip, see U.S. Pat. No. 5,501,239. However, hair clips are sometimes considered informal and the user may wish to wear a hair extension without the hair clip being visible.

BRIEF SUMMARY OF THE INVENTION

In one aspect, a method for fabricating a hair accessory to supplement a user's natural hair is provided. The method includes providing a plurality of hair strands and a hair clip. The method further includes attaching the hair strands to the clip such that the clip is substantially concealed by the strands when the clip is attached to the user's natural hair.

In another aspect, a hair accessory is provided. The hair accessory includes at least one support member and at least one connector member extending from the support member at two locations. The hair accessory further includes a hair clip including a body and at least one tooth extending from the body and interposed between the support member and the connector member. The hair accessory further includes a plurality of hair strands extending from the connector member.

In another aspect, a hair accessory is provided. The hair accessory includes at least one support member and at least two connector members, wherein each connector member extends substantially in a serpentine configuration from a respective first location of the support member to a respective second location of the support member. Each respective first location is substantially 180° apart from the respective second location, and the connector members are alternating in a serpentine configuration to form a plurality of openings interposed with a plurality of overlapping sections. The hair accessory further includes a plurality of hair strands extending from the connector member.

DETAILED DESCRIPTION OF THE INVENTION

Figure 1:
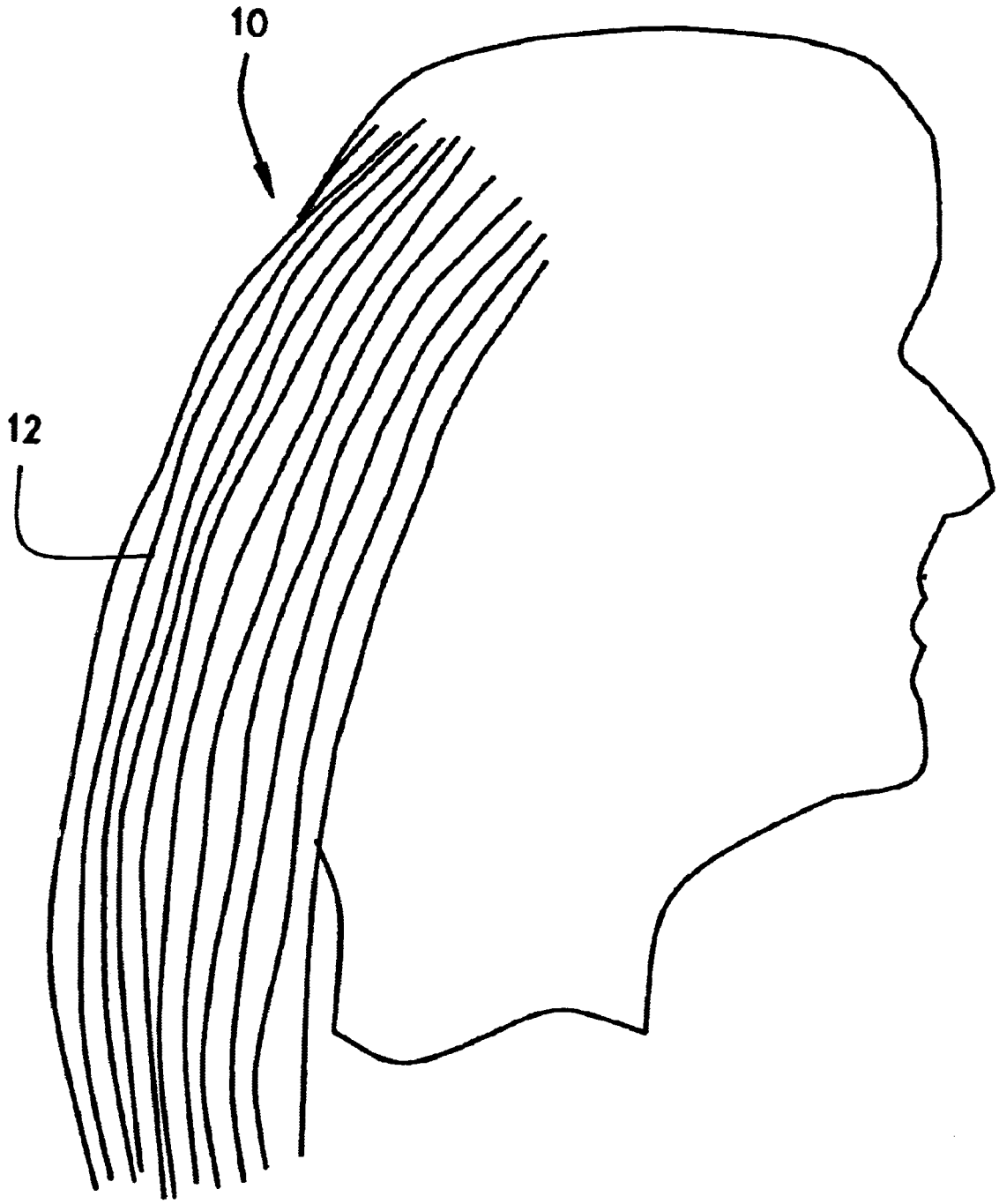
FIG. 1 is a perspective view of one embodiment of a hair accessory.

FIG. 1 is a perspective view of one embodiment of a hair accessory 10 including a plurality of hair strands 12. In an exemplary embodiment, strands 12 are synthetic hair fabricated from a polymer fiber. In one embodiment, the synthetic hair is fabricated from a modacrylic fiber. In an alternative embodiment, the synthetic hair is fabricated from a polymer fiber other than a modacrylic fiber such as, for example, an acrylic fiber. In another embodiment, hair strands 12 are natural hair. In a further embodiment, hair strands 12 are fabricated from at least one of natural hair and synthetic hair. A conventional hair clip (not shown in FIG. 1) is beneath strands 12 and is substantially concealed from sight by strands 12. In another embodiment, hair accessory 10 conceals the clip other than by strands 12, such as with a hair bow.

Figure 2:
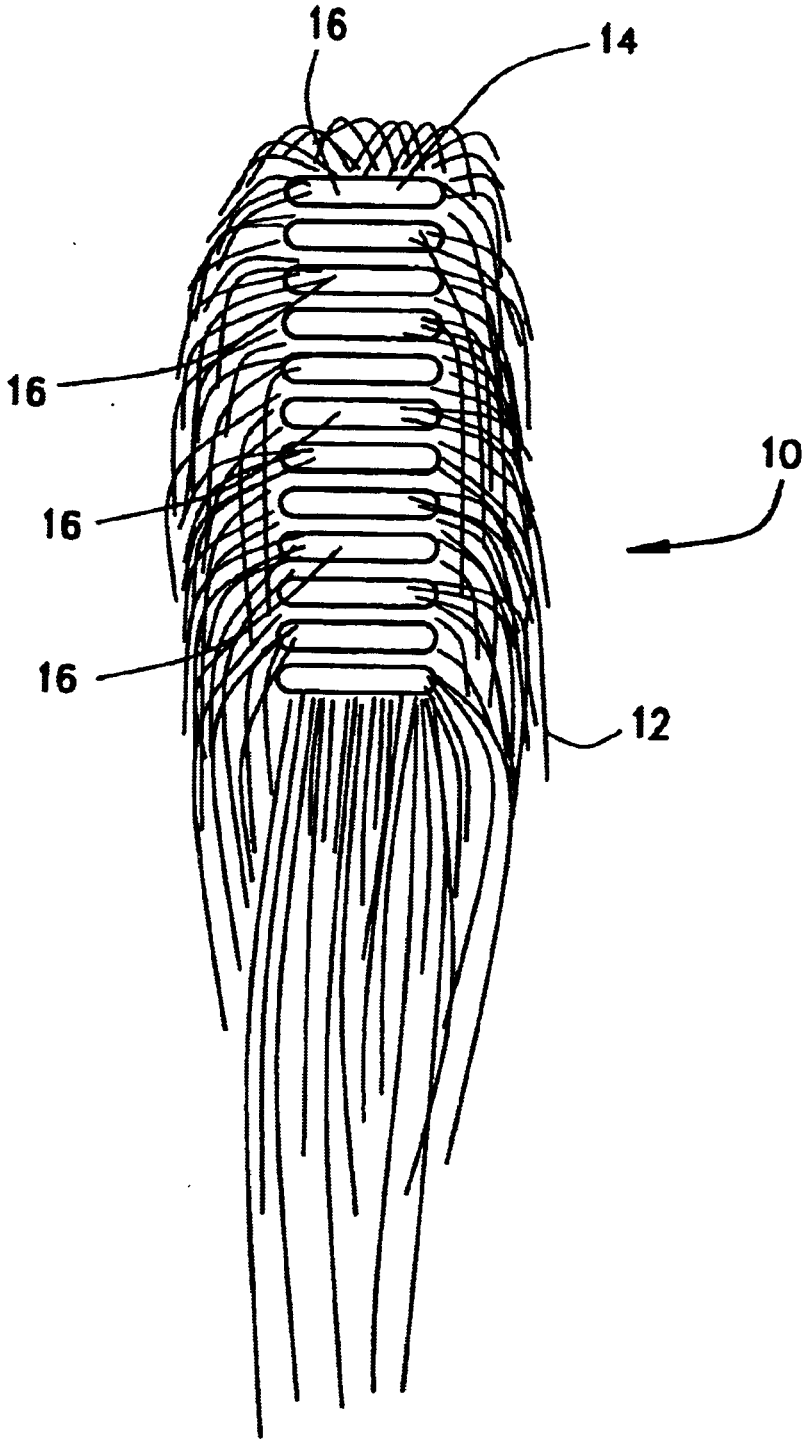
FIG. 2 is a front view of the hair accessory shown in FIG. 1 attached to a closed hair clip.
Figure 3:
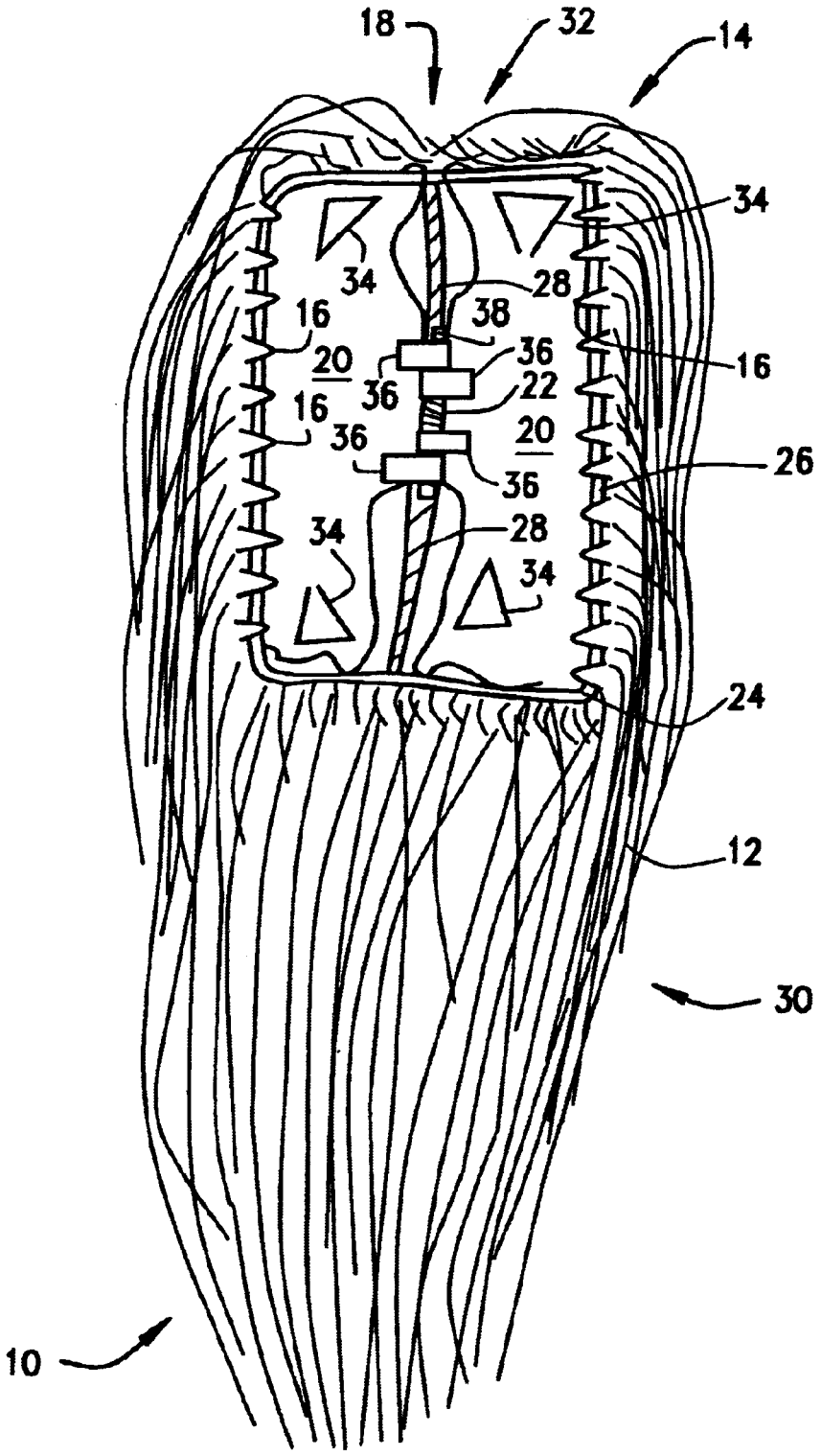
FIG. 3 is a front view of the hair accessory shown in FIG. 1 attached to an open hair clip.

FIG. 2 is a front view of hair accessory 10 attached to a closed hair clip 14 and FIG. 3 is a front view of hair accessory 10 attached to an open hair clip 14. Hair clip 14 includes a plurality of teeth 16 extending from a body 18. Body 18 includes a pair of body portions 20 biased to a closed position with a spring 22 as is known in the art. As shown in FIG. 2, when hair clip 14 is closed, body 18 is not visible, and strands 12 are arranged such that only teeth 16 are visible. Referring now to FIG. 3, hair accessory 10 includes a support member 24 which forms a closed path 26 interior to teeth 16.

Hair accessory 10 further includes a central member 28 extending from a first end 30 of accessory 10 to a second end 32 of accessory 10. In an exemplary embodiment, support member 24 and central member 28 are fabricated from a flexible material, such as, for example, a polyvinyl-chloride (PVC) fiber. Each body portion 20 includes a plurality of triangular openings 34 and a plurality of pivoting members 36. A pivot member 38 extends through spring 22 and pivoting members 36. Spring 22 biases hair clip 14 in a closed position and is centrally disposed in relation to pivoting members 36.

Figure 4:
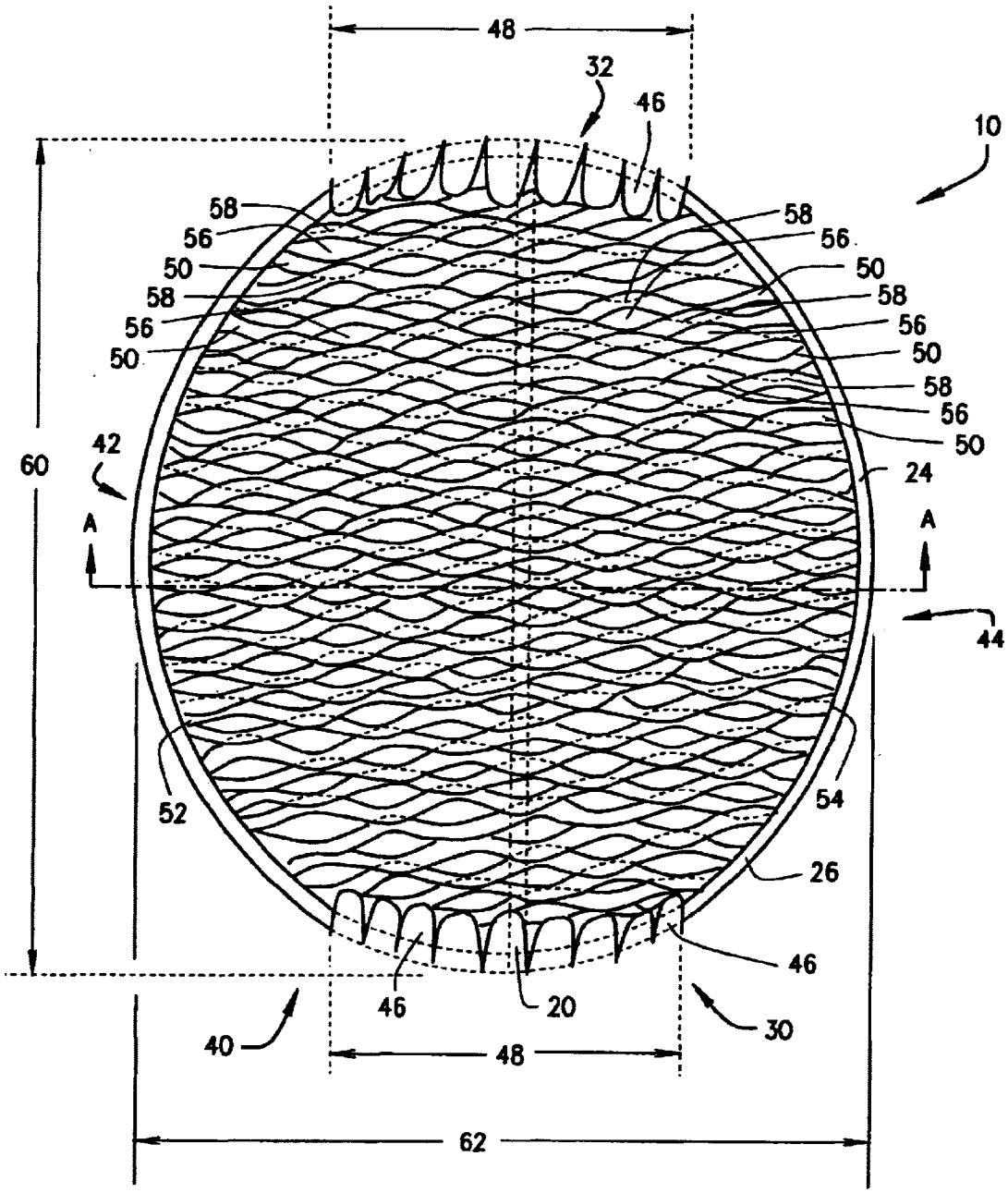
FIG. 4 is a plan view of an inside surface of the hair accessory shown in FIG. 1.

FIG. 4 is a plan view of an inside surface 40 of hair accessory 10 including a first side 42 and a second side 44. Support member 24 forms closed path 26 as explained above and is concealed from view at first end 30 and second end 32 by a plurality of inwardly extending end strand supports 46. Each end strand support 46 has sufficient strands attached to substantially conceal end portions 48 of support member 20 from view when viewed from an interior view (FIG. 4), an exterior view (FIG. 1), and from ends 30 and 32. In one embodiment, support member 24 does not form a closed path 26 and terminates at end portions 48. In another embodiment, support member does not form a closed path 26 and terminates at a location other than end portions 48. A plurality of connector members 50 extend from first side 42 to second side 44.

In an exemplary embodiment, connector members 50 extend in a serpentine configuration from first side 42 to second side 44. In one embodiment, connector members 50 extend from locations substantially 180° apart, such as, for example, a first location 52 and a second location 54. Connector members 50 are arranged alternating in a serpentine configuration to form a plurality of openings 56 interposed with a plurality of overlapping sections 58. Openings 56 facilitate an air flow through hair accessory 10. In an exemplary embodiment, connector members 50 are attached at overlapping sections 58. In one embodiment, connector members 50 are attached using an adhesive. In another embodiment, connector members 50 are sewn together. In a further embodiment, connector members 50 are heat fused together. Each connector member 50 includes hair strands 12 extending therefrom to substantially conceal view of connector members 50 when viewed externally as shown in Figure 1. Hair accessory 10 includes a length 60 and a width 62. Some of openings 56 are adjacent support member 24 such that when hair accessory 10 is mounted to hair clip .14 (shown on FIG. 2), teeth 16 extend through at least some of the adjacent openings such that support member 24 is interior to teeth 16 and connector members 50 extend exterior to teeth 16 and along a back surface (not shown) of clip 14. Accordingly, each tooth 16 is interposed between support member 24 and connectors 50.

Figure 5:
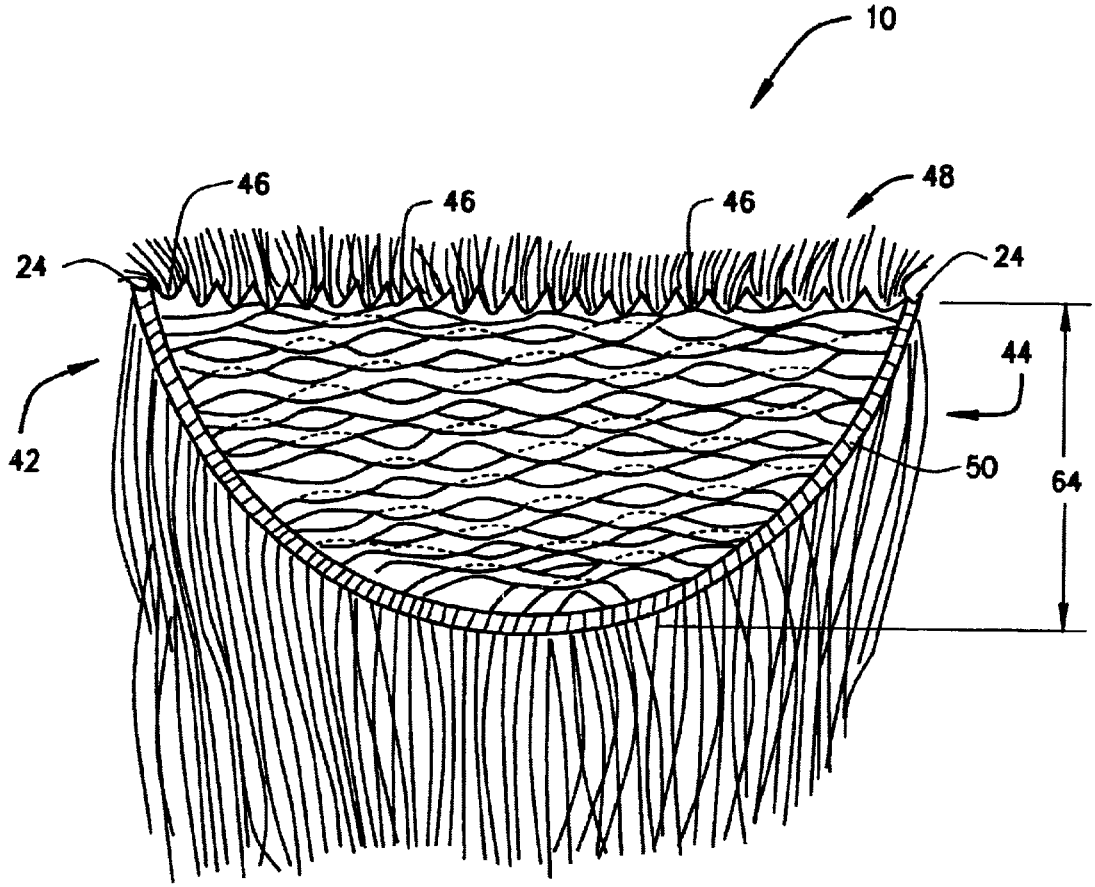
FIG. 5 is a cross-sectional view of the hair accessory shown in FIG. 1.

FIG. 5 is a cross-sectional view of hair accessory 10 along a line A—A (shown in FIG. 4) illustrating a cross-section of a particular connector member 50 extending from first side 42 of support member 24 to second side 44 of support member 24. End supports 46 are fabricated by extending connector members 50 past support member 24 at end 48 and folding the extended portions back and attaching the folded extended portions to portions of connector members 50 which do not extend past support member 24 such that support member 24 extends through the fold. In another embodiment, support member 24 terminates at end portions 48 and connector members 50 are folded upon themselves. In a further embodiment, additional connector members 50 are attached to the folded portions providing even greater strength and concealment than the folded portions provide. Hair accessory 10 further includes a depth 64. Depth 64, width 62 (shown in FIG. 4), and length 60 are sized to receive hair clip 14 such that substantially all of body 18 is contained therein.

In use, hair accessory 10 is mounted to hair clip 14 which is attached to a user's natural hair and hair accessory 10 conceals hair clip 14 providing a naturally appearing hair addition.

While the invention has been described in terms of various specific embodiments, those skilled in the art will recognize that the invention can be practiced with modification within the spirit and scope of the claims.

What is claimed is:

1. A method for fabricating a hair accessory to supplement a user's natural hair, said method comprising the steps of:

providing a plurality of hair strands;

providing a hair clip;

attaching the hair strands to the clip such that the clip is substantially concealed by the strands when the clip is attached to the user's natural hair;

attaching a plurality of hair strands to at least one connector member;

attaching the connector member to a support member; and attaching the support member to the clip such that at least one tooth of the clip is interposed between the support member and the connector member.

2. A method in accordance with claim 1 wherein said step of attaching the connector member further comprises the step of attaching the connector member to the support member at more than one location, wherein at least two locations are substantially 180° apart.

3. A method in accordance with claim 2 wherein said step of attaching the connector member further comprises the step of attaching at least two connector members to the support member such that each connector member extends in a serpentine configuration from a first side of the support member to a second side of the support member, wherein the connector members extend alternating in a serpentine configuration to form a plurality of openings interposed with a plurality of overlapping sections.

4. A method in accordance with claim 2 wherein said step of attaching the connector member further comprises the step of attaching at least two connector members to the support member such that each connector member extends in a serpentine configuration from a first side of the support member to a second side of the support member, wherein the connector member extend alternating in a serpentine configuration to form a plurality of openings interposed with a plurality of overlapping sections, wherein the connector members are attached at the overlapping sections.

5. A hair accessory comprising:

at least one support member;

at least one connector member extending from said support member in at least two locations, said connector member extends substantially in a serpentine configuration from a first side of said support member to a second side of said support member;

a hair clip comprising a body and at least one tooth extending from said body, said at least one tooth interposed between said support member and said connector member; and a plurality of hair strands extending from said connector member.

6. A hair accessory in accordance with claim 5 wherein said plurality of strands extend from said connector member such that said strands substantially conceal said hair clip when said hair clip attached to a head of a user.

7. A hair accessory in accordance with claim 5 wherein at least two said connector members extend alternating in a serpentine configuration from a first side of said support member to a second side of said support member such that a plurality of openings are interposed with a plurality of overlapped sections.

8. A hair accessory in accordance with claim 7 wherein said connector members are attached at said overlapped sections.

9. A hair accessory in accordance with claim 5 wherein said support member comprises a first end, said connector member extending past said support member at said first end and folded back upon a portion of said connector member not extending past said support member forming a fold wherein said support member extends through said fold.

10. A hair accessory comprising:

at least one support member;

at least two connector members, each said connector member extending substantially in a serpentine configuration from said support member at a respective first location of said support member to a respective second location of said support member, each said respective first location substantially 180° apart from said respective second location, said connector members alternating in a serpentine configuration to form a plurality of openings interposed with a plurality of overlapping sections; and a plurality of hair strands extending from said connector members.

11. A hair accessory in accordance with claim 10 further comprising:

a height;

a length; and a depth, said height, said length, and said depth sized to receive a hair clip such that a body of the hair clip is substantially contained therein.

12. A hair accessory in accordance with claim 10 further comprising:

a height;

a length; and a depth, said height, said length, and said depth sized to receive a hair clip such that a body of the hair clip is substantially concealed from sight by said strands.

13. A hair accessory in accordance with claim 10 wherein at least one said connector member extends past said support member at a first end and folds upon a portion of said connector member not extending past said support member to form a fold to substantially conceal an end portion of said support member from sight, said support member extending through said fold.

14. A hair accessory in accordance with claim 10 wherein said connector members attached at said overlapping portions.

15. A hair accessory in accordance with claim 10 wherein said hair strands comprise at least one of natural hair and synthetic hair.

16. A hair accessory in accordance with claim 15 wherein said synthetic hair comprises a polymer fiber.

17. A hair accessory in accordance with claim 16 wherein polymer fiber comprises a modacrylic fiber.

18. A hair accessory in accordance with claim 10 wherein said hair strands comprises a modacrylic fiber.

19. A hair accessory in accordance with claim 10 wherein said connector members are attached at said overlapped sections.

* * * * *